United States Patent [19]

Righi et al.

[11] Patent Number: 4,728,124

[45] Date of Patent: Mar. 1, 1988

[54] CONNECTION FOR DRILLING

[75] Inventors: Hervé Righi, Saint Jean de Moirans; Georges Obrecht, Seyssins, both of France

[73] Assignee: Alsthom, Paris, France

[21] Appl. No.: 24,279

[22] Filed: Mar. 10, 1987

[30] Foreign Application Priority Data

Mar. 10, 1986 [FR] France ..... 86 03377

[51] Int. Cl.[4] ..... E21B 17/06

[52] U.S. Cl. ..... 285/2; 285/3; 285/922; 175/320

[58] Field of Search ..... 166/301, 242; 175/320, 175/321; 285/2, 3, 4, 922; 403/2

[56] References Cited

U.S. PATENT DOCUMENTS

| | | | |
|---|---|---|---|
| 1,839,690 | 1/1932 | Malinowski | 285/2 |
| 3,387,863 | 6/1968 | Treese | 285/2 |
| 3,499,664 | 3/1970 | Burns | 285/2 |
| 3,842,914 | 10/1974 | Mott | 175/320 |
| 4,139,059 | 2/1979 | Carmichael | 285/4 |
| 4,459,060 | 7/1984 | Patterson | 403/2 |
| 4,473,125 | 9/1984 | Addudle et al. | 175/410 |
| 4,484,633 | 11/1984 | Brandell | 166/301 |

*Primary Examiner*—Stephen J. Novosad
*Assistant Examiner*—Bruce M. Kisliuk
*Attorney, Agent, or Firm*—Sughrue, Mion, Zinn, Macpeak, and Seas

[57] ABSTRACT

The invention relates to a safety connection for drilling purposes, especially for oil wells. The connection comprises two portions (1,2) which, during normal drilling, transmit the torque and the thrust required for the tool to operate, said torque and thrust being transmitted via a drive cone (11) and fluting (10). In the event of the tool becoming jammed downhole, strong axial traction breaks calibrated traction links (4) at a predetermined force, thereby separating said two portions (1, 2) and making it possible to abandon downhole solely the tool and the connection portion (1) connected thereto.

7 Claims, 5 Drawing Figures

CONNECTION FOR DRILLING

The present invention relates to drilling, in particular for oil exploration and production.

BACKGROUND OF THE INVENTION

Drilling oil wells is an expensive operation both in the equipment used and in the risks run. One of these risks is the risk of the drilling tool becoming jammed downhole, thereby jamming an entire drilling string which may be very expensive.

When such jamming occurs, the first operation normally performed consists in applying a large traction force to the drilling string from the surface in an attempt to unjam the tool. However the traction force which can be applied is limited by the risk of breaking the string or some of its components. If such traction is ineffective, the next procedure is to back off by attempting to disconnect two drillstems at as low a point as possible. (This conventional operation consists initially in applying a screwing torque in order to equalize the extent to which successive connections between stems are tightened, then in applying an unscrewing torque which is slightly less than the torque needed to disconnect the stems, and then in exploding a charge level with the connection to be unscrewed while the unscrewing torque is maintained. In this way, the portion of the drilling string above the unscrewed connection can be raised to the surface). Thereafter a string fitted with a hammer slide is lowered to apply axial traction shocks in an attempt to release the tool. If this operation is unsuccessful, a further backing off operation is performed and the unrecovered equipment is abandoned downhole.

The next operation consists in casting a cement plug. These operations end up with the loss of 200 to 300 meters of drilling string (heavy stems, MWD measurement equipment, motors, turbine, tools, . . . ), and 350 to 400 meters of drilling, not counting various side-tracking operations that will then be required to get out from the drilled hole.

This risk is a major risk when passing through unstable, cracked or heterogeneous ground.

The present invention seeks to avoid, or at least to minimize, the above-mentioned risks of loss.

SUMMARY OF THE INVENTION

The present invention satisfies at least the following point:

1. A drilling connection for connecting a drilling tool (26) to a drive member (25) rotatable about an axis (42) at the leading end of a drilling string, and then for transmitting working forces to said tool, i.e. forces comprising rotary torque and axial thrust to enable the tool to perform its work, and occasionally for transmitting limited withdrawal traction thereto in order to withdraw the tool together with the drive member, said connection comprising:

a tool connection structure (9) formed on a part connected to the tool;

a drive connection structure (8) formed on a part connected to the drive member in order to connect the tool to the drive member;

a leading connection body (1) having a connection structure (9) at its leading end complementary to said tool connection structure;

a trailing connection body (2) having a connection structure (8) at its trailing end complementary to said drive connection structure; and separable connection means (4, 10, 11) for transmitting said working forces and said withdrawal traction from said trailing body to said leading body, and for separating said bodies under the action of axial separation traction greater than said withdrawal traction in such a manner as to enable said bodies to be separated from each other in the event of the tool becoming accidentally jammed downhole sufficiently to resist said limited withdrawal traction, thereby enabling the drive member to be withdrawn while at least temporarily abandoning solely said leading body, said tool, and any parts that may be situated therebetween;

said connection including the improvement whereby said separable connection means between said connection bodies (1, 2) comprise a plurality of calibrated traction links (4) angularly distributed around said axis (42) and having calibrated breaking forces;

each of said links comprising a shank (19) extending axially between a leading head and a trailing head (16) and having limited traction strength so as to break at a predetermined force which is the calibrated or rated force for said link;

said leading and trailing bodies (1, 2) having leading and trailing housings (14, 15) for receiving said leading and trailing heads respectively, and for holding them against a force greater than said calibrated force; and said separable connection means further including means (10, 11) for transmitting torque and thrust between said two bodies.

The present invention preferably satisfies the following points as well: 2. A connection according to point 1, wherein said housings (14, 15) are constituted by recesses in the outer surfaces of said connection bodies (1, 2) and are suitable for receiving the heads (16) of various different calibrated traction links thereby enabling the value of said separation traction force to be easily changed;

said connection further including a protective sleeve (3) which surrounds said calibrated traction links and which is fixed to the assembly of both of said bodies during drilling.

3. A connection according to point 2, wherein said tool connection structure (9) is a male thread which co-operates with a complementary female thread formed on said leading body (1) in order to fix the tool to said body by applying a screwing torque to said body in the same direction as said working torque, said driving connection structure (8) being a female thread which co-operates with a complementary male thread formed on said trailing body (2) in order to fix said trailing body to said drive member (25);

said protective sleeve (3) including rotary locking elements (22) at its leading end co-operating with complementary locking elements (23) formed in the side wall of said leading body (1) in order to prevent relative roation therebetween while still allowing axial displacement of said sleeve relative to said body, a trailing portion of said sleeve being mounted free to rotate on said trailing body (2) in order to allow said rotary locking elements to be engaged in said complementary elements regardless of the relative angular position between said bodies during assembly of the connection;

means (44) being provided to hold said sleeve axially in position at least when said two bodies are fixed to each other and to said drive member (25);

said means for transmitting torque between said two bodies comprising complementary axial torque-transmitting fluting (10) formed on said two bodies in such a manner that, during assembly of the connection, the application of a screwing torque to said protective sleeve ensures that said trailing body is screwed to said drive member (25) via said rotary locking elements of said sleeve and said torque-transmitting fluting.

4. A connection according to point 1, wherein said leading body (1) includes means (28) on its trailing portion for reconnection to a fishing member (40) in order to allow said body and said tool (26) to be fished after being temporarily abandoned downhole.

5. A connection according to point 1, wherein said separable connection means between said connection bodies (1, 2) comprise torque-transmitting and thrust-transmitting means which are constituted by complementary male and female cones (11) formed on said two bodies.

6. A connection according to point 5, wherein said transmission cone (11) formed on said leading body has a conical reconnection thread (28) formed therein suitable for co-operating with a complementary thread formed on the fishing member (40) in order to enable said body and said tool (26) to be fished after being temporarily abandoned downhole.

7. A connection according to point 1, wherein said drive member (25) is the drive shaft of a downhole motor such as a positive displacement motor or a turbine.

The safety connection is thus inserted between the tool and the first stem of the string (i.e. between the tool and the drill collar (or between the tool and the leading end of the downhole motor shaft)). This connection allows drilling to take place under the same conditions as before but has the special feature of breaking into two parts when subjected to a predetermined traction force: namely one part constituted by the trailing body which can be raised with the rest of the string and another part constituted by the leading body connected to the tool.

As a result, the connection can be used not only to raise the entire string, while simultaneously avoiding the difficult backing off operation, but also to lower a special fishing member right down to the jammed tool together with hammering means so as to apply fishing forces directly to the tool, thereby making said forces as efficient as possible. In the event that the jammed tool cannot be fished out, then only a few tens of meters of drilling are lost.

This connection is particularly useful when using Moineau type positive displacement motors since the insertion of such motors in a drilling string makes it impossible to perform backing off operations because these motors require the bottom of the drilling string to be stationary in rotation relative to the ground (backing off can still be performed with turbine motors by providing means for locking the shaft to the body, e.g. using a jet of beads directed into notched rings). The bead-locking technique can be used with a turbine because the top end of the shaft turns "round", but cannot be used with a Moineau-type motor because of the very peculiar action of its rotor.

BRIEF DESCRIPTION OF THE DRAWINGS

Embodiments of the invention are described by way of example with reference to the following diagrammatic figures. When the same item is shown in several of the figures it is designated in each of them by the same reference sign. Whenever such reference signs are used above in defining the invention they are used solely to facilitate reference to the figures and should not be taken as being limiting in any way. Naturally, the elements mentioned specifically may be replaced by other elements providing the same technical functions.

In the drawings.

MORE DETAILED DESCRIPTION

Figure 1:
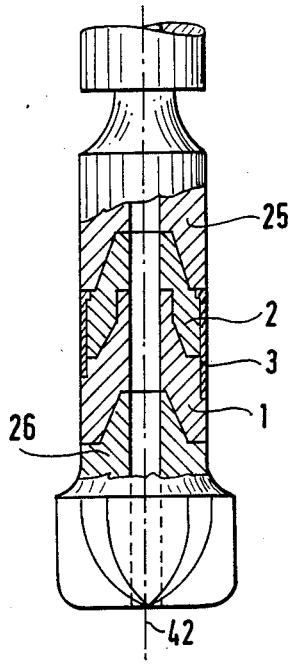
FIG. 1 is an elevation view of the leading downhole portion of a drilling device provided with a first connection in accordance with the invention, and shown in partial section on a plane passing through the axis thereof.

The first device described embodies above-mentioned points 1 to 6. It comprises four main elements:

a tool carrier 1 which constitutes the above-mentioned leading body;

a shaft end fitting 2, said end fitting constituting the above-mentioned trailing body;

a protective sleeve 3; and snapping test pieces 4 which constitute the above-mentioned calibrated traction links.

In the drilling position, the safety connection is fixed to the leading end of the shaft 25 of a motor (e.g. a turbine or a Moineau-type positive displacement motor) by means of an API-type conical thread formed on the end fitting 2. This shaft's leading end constitutes the above-mentioned drive member. The parts are fixed together by means of comb-type drilling keys such as those used on offshore drilling rigs having an active portion which may be applied equally well to the outside diameter of the protective sleeve 3 or of the tool carrier 1.

The leading end of the tool carrier 1 is fitted with an API conical thread 9 which receives the drilling tool 26. Naturally the threads 8 and 9 are complementary to each other. The tool carrier 1 is mounted on the end fitting via a fluted end 10 which is concentric with a drive cone 11 whose dimensions are designed so that the respective faces 12 and 13 are very close to each other.

Housings 14 and 15 are disposed in the tool carrier 1 and in the end fitting 2 on either side of the faces 12 and 13 in order to receive the enlarged heads 16 of the test pieces 4 and with slots 17 and 18 through which the shanks 19 of the test pieces pass, said shanks being calibrated to break under given traction force.

Figure 2:
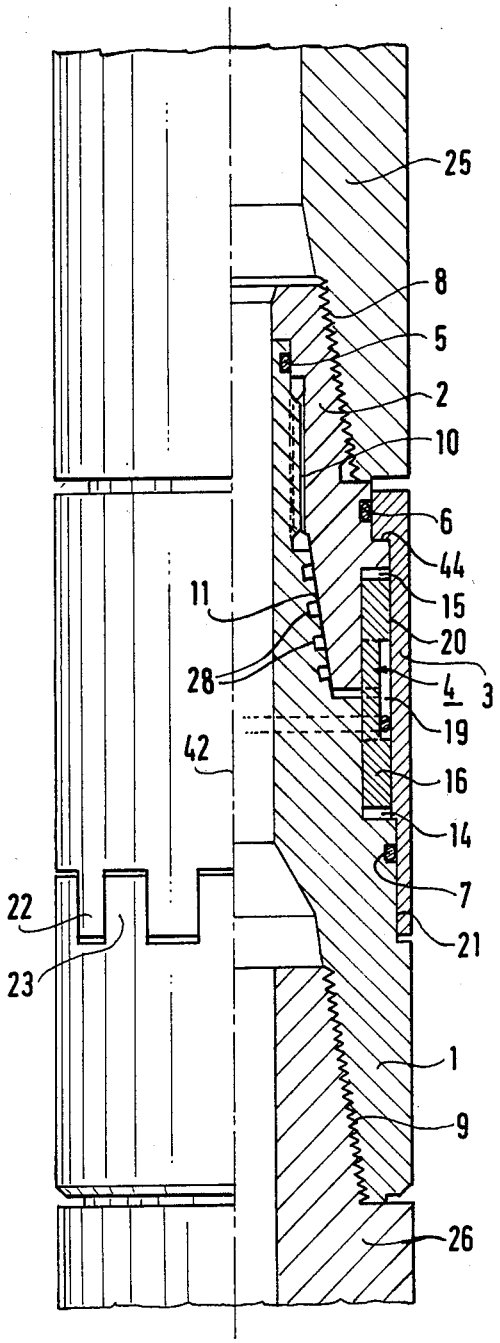
FIG. 2 is an elevation view of said connection in half axial section with the drilling tool removed.
Figure 3:
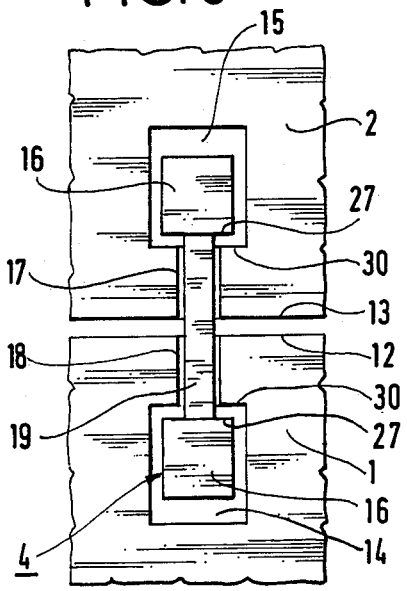
FIG. 3 is a fragmentary side view of the connection with the protective sleeve removed to show the calibrated traction links.

The protective sleeve 3 fits over the diameters 20 and 21 in order to provide mechanical protection and sealing of the zone in which the test pieces are housed. It is slide into place from the trailing end of the end fitting 2 and sealing is provided by sealing rings 6 and 7. The leading portion 22 of the sleeve (see FIG. 2) is provided with large square teeth which engage in corresponding square teeth 23 provided in the tool carrier 1. This arrangement prevents sliding when the cone-type keys conventionally used in oil drilling are locked and unlocked. The trailing portion of the sleeve has an inwardly-directed annular flange 44 which abuts at its leading edge against a complementary shoulder on the end fitting 2.

Operation is as follows: during drilling, the working torque and the working axial thrust (tool weight) are directly transmitted from the leading end 25 of the drive shaft to the tool 26 via the fluting 10 and the tightly clamped cones 11.

During extraction, when a traction force is intended to extract a tool 26 which has jammed in the hole it is drilling, the upwardly-directed traction is initially transmitted by the wedged cones 11.

If this traction is sufficient for unjamming the tool, drilling may continue after the normal precautions have been taken.

Otherwise, the cones 11 come apart and the end fitting 2 moves away from the tool carrier 1, which movement brings the faces 27 of the test pieces into contact with the faces 30 of the housings 14 and 15. Traction is now transmitted via the test pieces 4. The number of test pieces and their rated breaking force define the force at which breaking will occur.

On breaking, the end piece 2 and the sleeve 3 can be raised to the surface together with the motor and the trailing ends of the test pieces.

Figure 4:
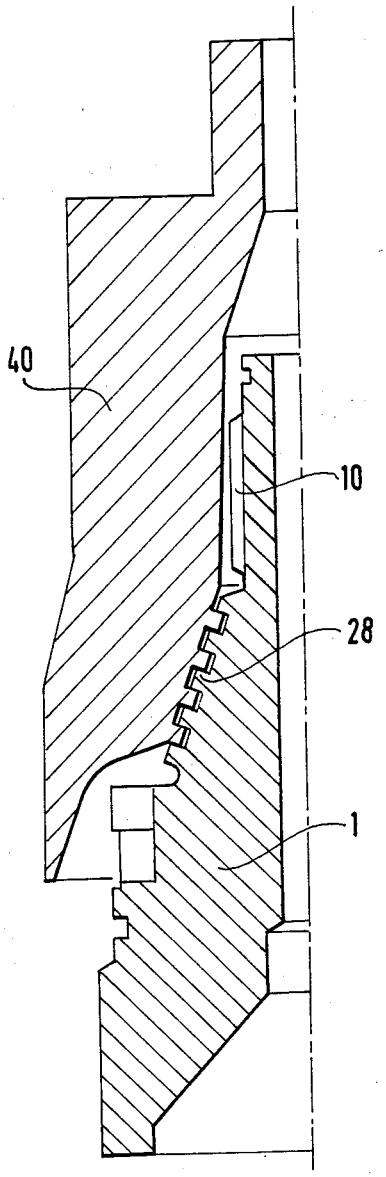
FIG. 4 is a half axial section through the leading body of the connection connected to a fishing member.

The tool carrier 1 remains downhole connected to the tool 26. A string fitted with a hammer slide and a fishing member 40 (see FIG. 4) having a thread which is complementary to the thread 28 in the drive cone 11 is then lowered downhole. Extraction can then be performed with maximum effectiveness.

Figure 5:
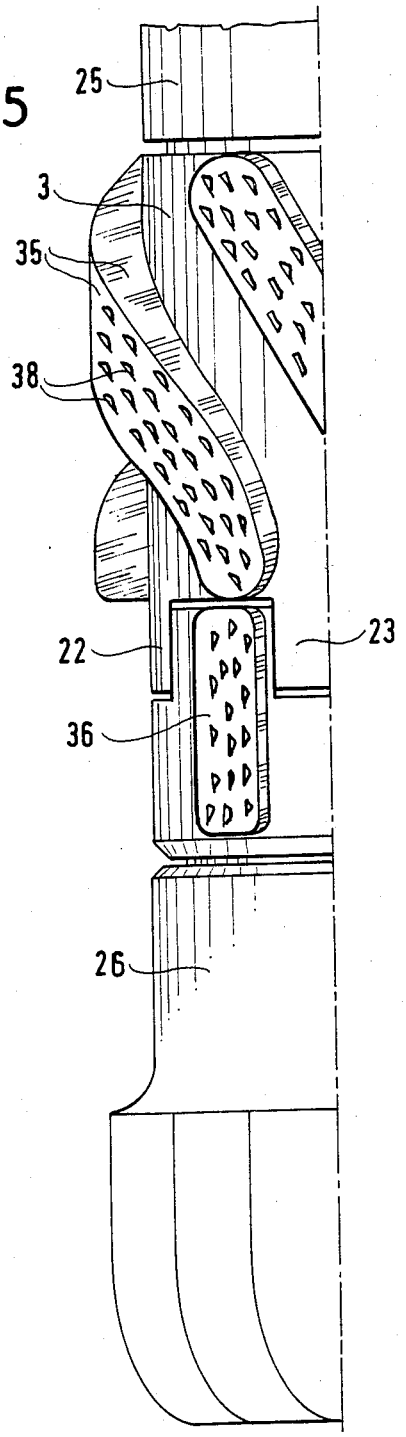
FIG. 5 is a fragmentary elevation half view of a drilling device fitted with a second connection in accordance with the invention.

The second embodiment of a connection in accordance with the invention as shown in FIG. 5 additionally constitutes a tool skirt known as a "near bit".

This bit is a member which withstands wear, whose outside diameter is equal to the diameter of the tool, and which serves firstly to smooth the walls of the drilled hole, and secondly to guide the tool effectively. This second safety connection has all the advantages of the first safety connection as described above plus those of a near bit, while avoiding the drawback of increased length. In particular, this connection satisfies abovementioned points 1 to 7. It is constituted by the same parts as the first described connection except as follows: the protective sleeve 3 has helical or rectilinear projections 35 having an outside diameter equal to the diameter of the tool and located on its downstream portion.

These projections are aligned with rectilinear projections 36, for example, on the tool carrier 1 which also projects to the tool diameter. These projections 35 and 36 are separated by axial paths or "water-ways" for drilling mud, and they are provided on their outer surfaces with anti-wear elements made of tungsten carbide or of industrial diamonds.

The teeth 22 and 23 may be provided, for example, at the same pitch as the projections 35 and 36.

We claim:

1. In a drilling connection for connecting a drilling tool to a drive member rotatable about an axis at the leading end of a drilling string, and for transmitting working forces to said tool, i.e. forces comprising rotary torque and axial thrust to enable the tool to perform its work, and occasionally for transmitting limited withdrawal traction thereto in order to withdraw the tool together with the drive member, said connection comprising:

a first tool connection structure on said tool;

a leading connection body having a second tool connection structure at its leading end complementary to said first tool connection structure;

a first drive connection structure on said drive member in order to connect the tool to the drive member;

a trailing connection body having a second drive connection structure at its trailing end complementary to said first drive connection structure; and separable connection means for transmitting said working forces and said withdrawal traction from said trailing connection body to said leading connection body, and for separating said bodies under the action of axial separation traction greater than said withdrawal traction in such a manner as to enable said bodies to be separated from each other in the event of the tool becoming accidentally jammed downhole sufficiently to resist said limited withdrawal traction, thereby enabling the drive member to be withdrawn while at least temporarily abandoning solely said leading connection body, said tool, and any parts that may be situated therebetween;

the improvement wherein said separable connection means between said connection bodies comprise a plurality of calibrated traction links angularly distributed around said axis and having calibrated breaking forces;

each of said links comprising a shank extending axially between a leading head and a trailing head and having limited traction strength so as to break at a predetermined force which is the calibrated or rated force for said link;

said leading and trailing bodies having leading and trailing housings for receiving said leading and trailing heads respectively, and for holding them against a force greater than said calibrated force; and said separable connection means further including means for transmitting torque and thrust between said two bodies.

2. A connection according to claim 1, wherein said housings are constituted by recesses in the outer peripheral surfaces of said connection bodies to receive various sized different calibrated traction links thereby enabling the traction strength of said links to be easily changed; and said connection further including a protective sleeve surrounding said calibrated traction links and fixed to both of said connection bodies.

3. A connection according to claim 2, wherein said first tool connection structure is a male thread which which engages a complementary female thread defining said second tool connection structure formed on said leading connection body in order to fix the tool to said leading connection body by applying a screw torque to said leading connection body in the same direction as said working forces, and said first drive connection structure is a female thread which engages a complementary male thread formed on said trailing connection body in order to fix said trailing connection body to said drive member;

said protective sleeve includes rotary locking elements at its leading end co-operating with complementary locking elements formed in the side wall of said leading connection body in order to prevent relative rotation therebetween while still allowing axial displacement of said sleeve relative to said leading connection body, a trailing portion of said sleeve is mounted free to rotate on said trailing connection body in order to allow said rotary locking elements to be engaged in said complementary elements regardless of the relative angular position between said leading and trailing connection bodies during completion of the connection;

means are provided to hold said sleeve axially in position at least when said two connection bodies are fixed to each other and to said drive member; and said means for transmitting torque between said two bodies comprises complementary axial torque-transmitting fluting formed on said two connection bodies in such a manner that, during completion of the connection, the application of a screwing torque to said protective sleeve ensures that said trailing connection body is screwed to said drive member via said rotary locking elements of said sleeve and said torque-transmitting fluting.

4. A connection according to claim 1 for permitting retrieval from a bore hole by a fishing member, wherein said leading connection body further includes means on its trailing portion for reconnection to said fishing member in order to allow said leading connection body and said tool to be fished after being temporarily abandoned downhole.

5. A connection according to claim 1, wherein said separable connection means between said connection bodies comprise torque-transmitting means and thrust-transmitting means, and wherein said thrust transmitting means are constituted by complementary face abutting, male and female transmission cones formed respectively on said two connection bodies.

6. A connection according to claim 5 for permitting retrieval from a bore hole by a fishing member, wherein said transmission cone formed on said leading connection body has a conical reconnection thread formed therein suitable for engagement with a complementary thread formed on said fishing member in order to enable said leading connection body and said tool to be fished after being temporarily abandoned downhole.

7. A connection according to claim 1, wherein said drive member is the drive shaft of a downhole motor such as a positive displacement motor or a turbine.

* * * * *